United States Patent [19]

Prestipino Giarritta et al.

[11] Patent Number: 4,955,632

[45] Date of Patent: Sep. 11, 1990

[54] SAFETY FASTENINGS FOR "SURF" SNOWBOARDS

[76] Inventors: Adriano Prestipino Giarritta, Via Einaudi, 21/bis-10052 Bardonecchia Turin; Fabrizio Robba, Frazione Les-Arnauds, 25-10052 Bardonecchia Turin, both of Italy

[21] Appl. No.: 330,161

[22] Filed: Mar. 29, 1989

[30] Foreign Application Priority Data

Mar. 30, 1988 [IT] Italy ..... 67286 A/88

[51] Int. Cl.[5] ..... A63C 5/00

[52] U.S. Cl. ..... 280/607; 280/14.2; 280/617

[58] Field of Search ..... 280/607, 624, 618, 617, 280/616, 14.2, 600

[56] References Cited

U.S. PATENT DOCUMENTS

| | | | |
|---|---|---|---|
| 4,652,007 | 3/1987 | Dennis | 280/14.2 |
| 4,792,155 | 12/1988 | Besnier | 280/14.2 |
| 4,869,522 | 9/1989 | Besnier et al. | 280/607 |

FOREIGN PATENT DOCUMENTS

| | | | |
|---|---|---|---|
| 147753 | 7/1985 | European Pat. Off. | 280/618 |
| 2600546 | 12/1987 | France | 280/607 |
| 2610838 | 8/1988 | France | 280/607 |
| 2610839 | 8/1988 | France | 280/607 |
| 2611516 | 9/1988 | France | 280/607 |
| 2615115 | 11/1988 | France | 280/607 |

*Primary Examiner*—Charles A. Marmor
*Assistant Examiner*—Eric Culbreth
*Attorney, Agent, or Firm*—Fiddler & Levine

[57] ABSTRACT

Safety fastenings for snowboards are mounted transversally with respect to the longitudinal axis of the board, characterised by the fact that they are provided with interdependent automatic releases, connecting two twin fastenings. The releases are brought into the "active" position i.e. with fastenings fixing the skier's ski boots and are provided with an actuating element such as a lever or a push button placed under the sole of each ski boot, which by means of mechanical, hydraulic or pneumatic connectors, is connected to the releases. The actuating elements are subject to the weight of the skier and remain in an inactive position when pressed but cause the opening of the twin fastening immediately if, for any reason, the pressure transmitted by a ski boot ceases.

3 Claims, 4 Drawing Sheets

14
14a
12
12a
21
22
23
24
25
25a
26
27
28
X
6
7
30
28a

SAFETY FASTENINGS FOR "SURF" SNOWBOARDS

Among the many varieties of winter sports, the "surf" snowboard is now widely used.

This board is considerably wider than the traditional pair of skis and is provided with two fastenings, fixed on its upper side in an almost transverse position with respect to the longitudinal axis.

The fastenings, clamped to the boots, fix the skier's feet to the board, allowing him to make downhill runs, shifting the weight of the body in order to keep his balance and a correct dynamic position.

The fastenings presently known for snowboards, as opposed to the fastenings used for skis or monoskis used for downhill skiing, are rigidly fixed to the board, with no elastic movement and with no safety devices. If the skier falls, or one of the fastenings breaks, the twin fastening does not open, which means that the board remains fixed to one of the skier's feet, constituting a serious danger to the skier should he fall.

To create safe conditions for the snowboard skier it is therefore indispensable that if one of the fastenings opens for any reason, the other fastening automatically and simultaneously frees the other foot, still fixed to the board.

The purpose of the invention is to provide interdependent, automatic safety fastenings for snowboards, able to operate the automatic opening of one fastening if the other fastening, for any reason, frees the corresponding foot. To this end, the safety fastenings for snowboards, which are the subject of the invention, are characterised by the fact that they are connected to each other by mechanical means, which may be hydraulic or pneumatic as long as they can cause the simultaneous opening of the other fastening in case one is freed from the ski boot worn by the skier.

Figure 1:
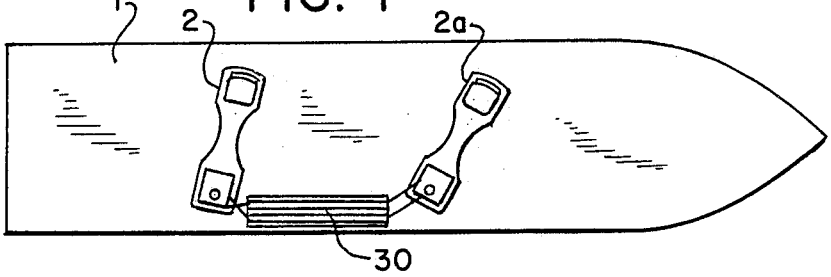
Figure 2:
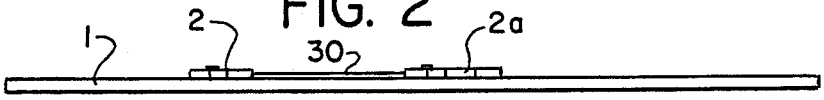
Figure 4:
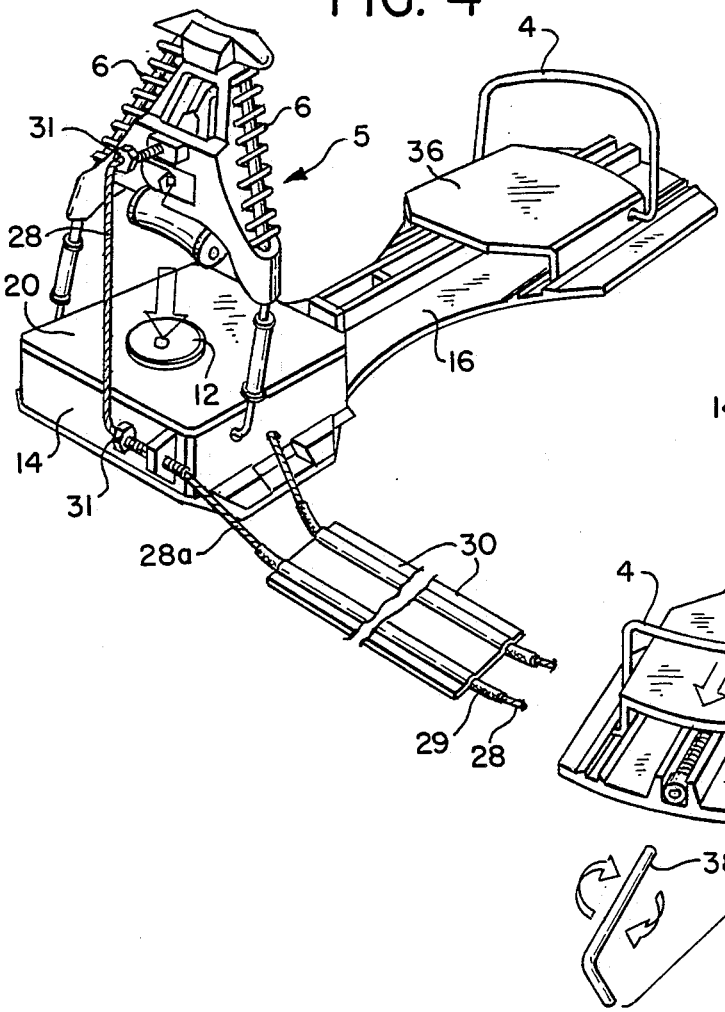
Figure 3:
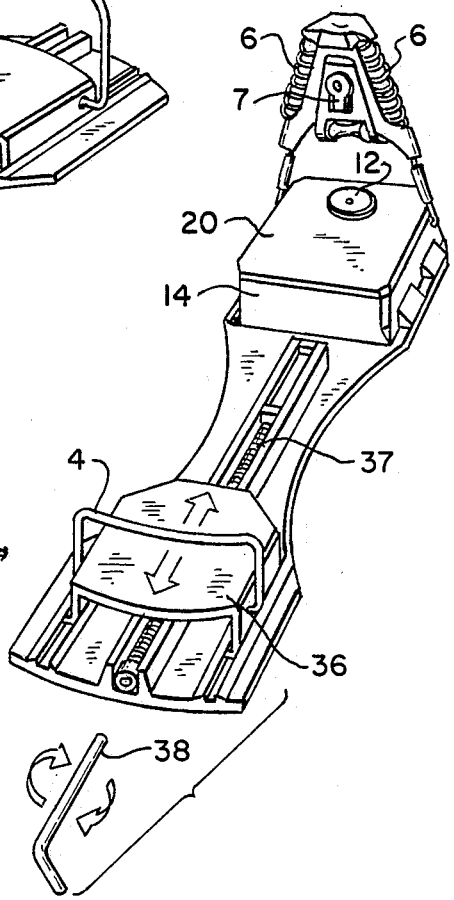
Figure 5:
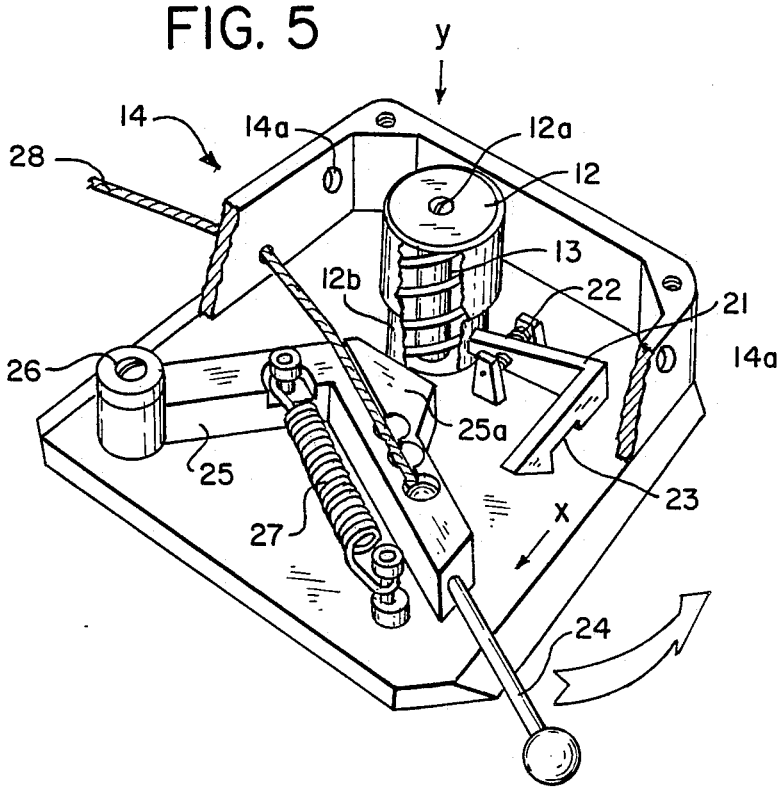
Figure 6:
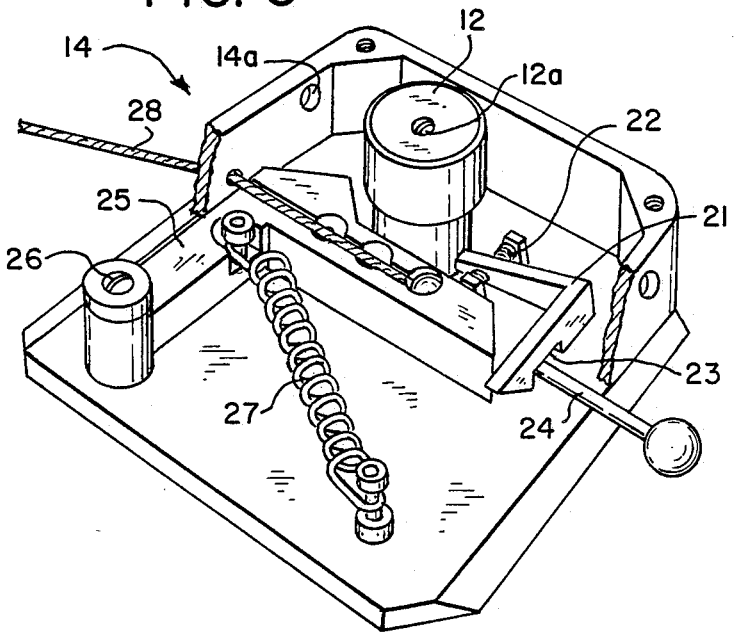
Figures 7, 8:
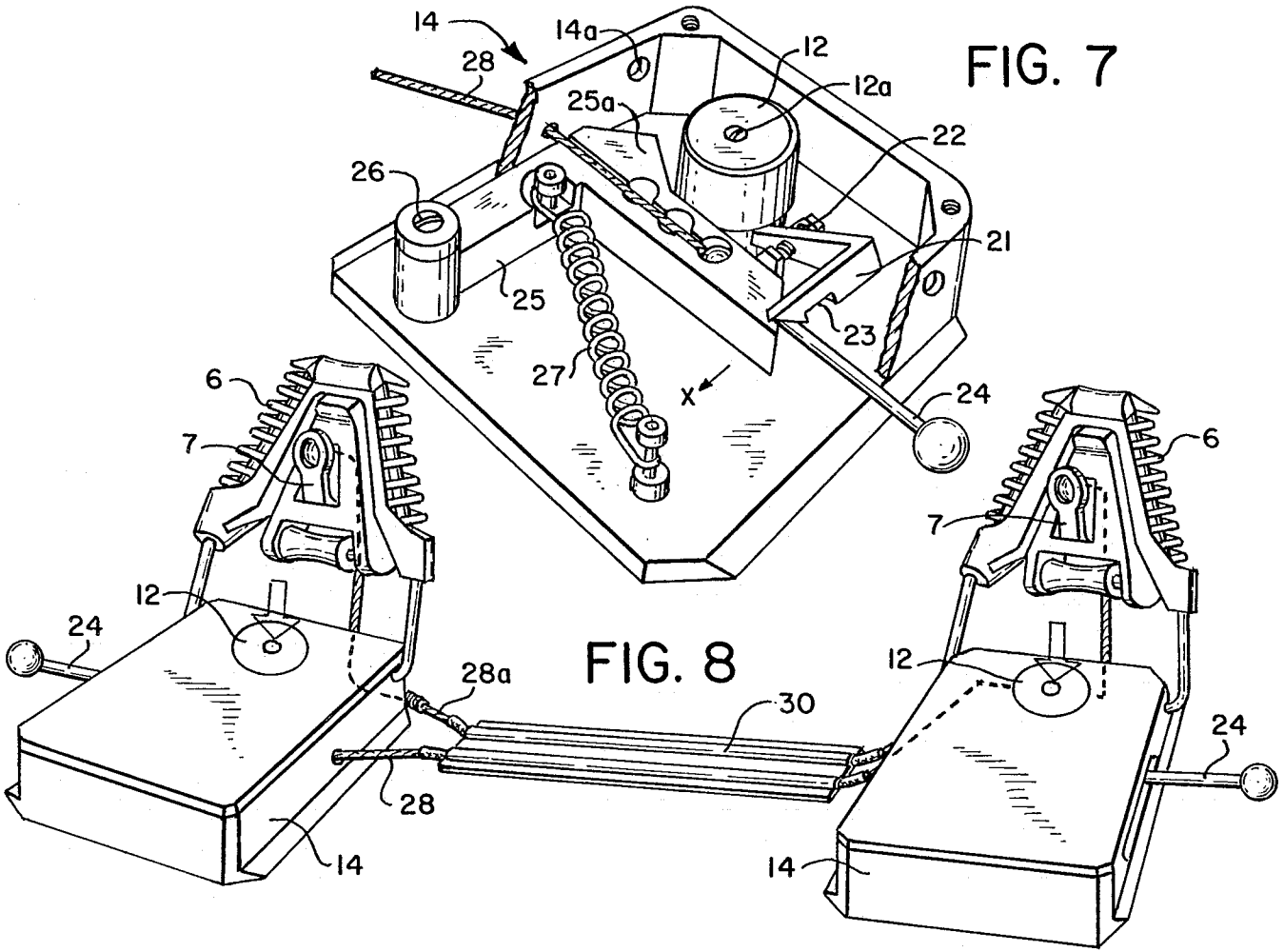
Figure 9:
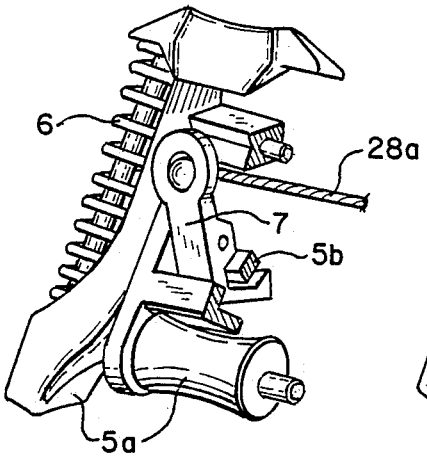
Figure 10:
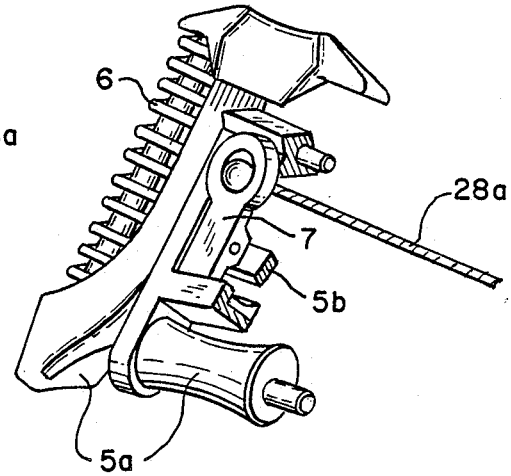
Figure 11:
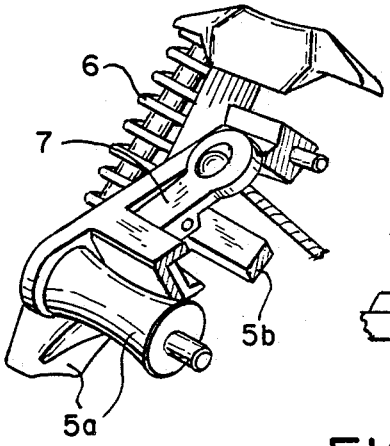
Figure 12:
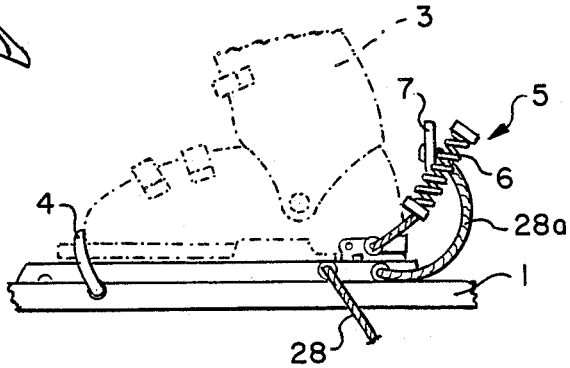
Figure 13:
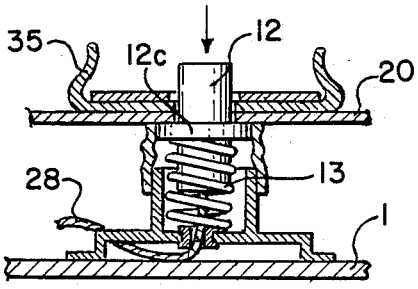

The fastenings according to the inventioin are now described with reference to the attached, illustrative drawings, in which:

FIG. 1 is a top view of a snowboard provided with the fastenings according to the invention, FIG. 2 is a side view of the same, FIG. 3 is a perspective, front view of one of the fastenings, FIG. 4 is a perspective, rear view of the same, FIGS. 5, 6 and 7 are axonometric view of the mechanism of each fastening, in three different positions, FIG. 8 is an axonometric view of two twin fastenings, FIGS. 9, 10 and 11 are partial views of the rear part, split in half, of a preferred, non exclusive heel clamp organ for the ski boots, FIG. 12 is a side view showing a ski boot fixed to the snowboard by one of the fastenings according to the invention, FIG. 13 shows a variant relating to another embodiment described below.

In FIGS. 1, 2, 3, 12 the fastenings 2, **2*a* are fixed to the snowboard 1, provided in the front with bridge-shaped grips 4 which engage the front projecting edge of a ski boot 3**, and which are blocked at the back by the heel grip.

The covers 20 of the back part of each fastening close the boxed in bodies 14. On the opposite sides of each of said bodies, are hinged the extremities of pairs of springs 6 of a well-known type of downhill ski fastening, provided with a two-way lever 7 which can block or unblock (e.g. engage or release) the heel of the ski boot 3, depending on the position the parts **5*a* are forced to assume. See FIGS. 9 to 12. The working of this popular kind of heel grip is known. When the fastening blocks engage the corresponding ski boot the lever 7 is in the position as shown in FIG. 9. When said lever, moves from the position illustrated in FIG. 10 into the position as shown in FIG. 11, it is released from the stop position 5*b*, and the reaction of the spring 6, by a snap action, releases the back part of the ski boot 3**.

A cylindrical or prismatic push button 12 projects from the centre of the cover 20 of each fastening, through a suitable hole, said button being subjected to the reaction of springs 13, which are rated and compressed, coaxial to the pin **12*a* and fixed to the bottom of the corresponding boxed in body 14, FIG. 5. In the example illustrated in FIGS. 5, 6, the push button 12, which is shaped like an upsidedown cup, is telescopically mounted on the fixed case 12*b*, which contains the spring(s) 13, FIG. 5. Said push button 12 can slide up and down with respect to the case 12*b* against spring 13 in the direction indicated by the arrow Y, counter reacting to the spirng 13 movement of button 12; in the opposite direction is limited by the pin 12*a*, formed for example by a set screw. An angular dog-leg shaped lever 21 is mounted in the box 14, oscillating as a pivot around a pin 22, FIGS. 5, 6, 7. An arm of the lever 21 is positioned so as to intervene on the vertical path of the lower edge of the push button 12; the opposite arm of said lever, provided with a stopping groove 23, engages and captures a control handle 24, which projects from the box through an opening 29, FIGS. 5 to 8. The handle 24 is fixed to an angular section or member 25, rotatably hinged to the bottom of the box 14; said angular member 25 is provided with a projecting part, 25*a*. A tension spring 27 biases the angular member 25 from the position shown in FIG. 6 to the position shown in FIG. 5. One end of a wire rope 28, adjustable in length, is connected to an arm of the member 25, fixed to the control handle 24. The wire rope 28 exits from the side of the box 14, opposite the control handle 24 and, by means of a sheathed portion 29, protected by a plate 30 fixed to the upper side of the snowboard, extends to the twin fastening. The opposite extremity 28*a* of the wire rope 28, by means of tension regulators 31, FIG. 4, is fixed to the lever 7 which controls the position of the heel grip 5** of the twin fastening.

The two fastenings 2, **2*a*, FIG. 1, are therefore connected one to the other by means of a pair of wire ropes, each of which originates from the mechanism contained in the box 14 of one and extends to the lever 7** of the other.

The use and the working of the fastenings described above is as follows.

The handle 24 of each fastening, is moved in such a way as to bring it from the position as shown in FIG. 5 into the position as shown in FIG. 6. The stopping means 23 of the pivot lever 21, downwardly biased by torsion spring 22 engages the lever 24 and holds the member 25 in the position as shown in FIG. 6. The heel of each ski boot 3, worn by the skier, is positioned to rest on the push button **12*a* of the corresponding fastening as seen in FIG. 12 and the bridge-shaped front parts 4 block or engage the toe of the ski boot in the known way. By exerting adequate pressure with the ski boot heel on the push button 12, the lower edge of the said push button acts on the extremity of the pivot lever 21 which assumes the position as shown in FIG. 7, freeing the handle 24 from engagement by groove 23. The member 25 effects a minimum angular movement due to the traction of the spring 27 because it is blocked by the projection 25***a* which stops against the push button 12 as best seen in FIG. 7. The condition remains unchanged until the weight of the skier is placed on the push button 12 of both the fastenings of the ski boots, even if the grooves 23 do not engage the corresponding control levers 24.

Should, for any reason, the pressure exerted on one or the other push button 12, of one or the other fastening by the corresponding ski boot, cease, the unweighted push button springs up and returns to the position illustrated in FIG. 5, due to the reaction of the corresponding spring 13. The projection 25*a* of the member 25 is freed from the stop constituted by the push button jacket 12 which is raised; the member 25, due to the action of the spring 27, returns to the position as illustrated in FIG. 5 and pulls the wire rope 28 connected to the lever 7 of the other fastening. The lever 7, due to detraction exerted by the wire rope 28 passes from the position illustrated in FIG. 9 to that shown in FIG. 11, causing the heel grip 5 to release the fastening of the corresponding ski boot due to the reaction of the springs 6.

From the above description, it is clear that if, for any reason, one of the fastenings releases the corresponding ski boot, the push button 12 of the other fastening causes the twin fastening to be released and both of the skier's feet are immediately freed from the snowboard 1.

According to the variant shown in FIG. 13, one extremity of the metal rope 28 can be directly connected to the push button 12 of the device of both fastenings and, respectively, to the lever 7 which opens the twin fastening. Also in this case, both the push buttons 12 slide through the cover 20 of the box 14 and the plate 35 of the back part of the fastening, present in some fastenings. In this case the push button 12 is provided with a collar 12*c* which intervenes on the part 25*a* of the member 25 and on the extremity of the pivot lever 21, also acting as a stop against the cover 20 when the device snaps and returns to the position as shown in FIG. 5.

The boxes 14 containing the devices are preferably connected to the grip 4 by means of a metal base 16. The extremities of the grip 4 are rotatably hinged to the sides of a guide 36, FIGS. 3, 4, adjustable into position along a screw 37 by means of a suitable key 38, FIG. 3.

The box 14 can be placed at any other point, except under the heel, as long as it is under the sole of the other ski boot.

The interdependence of the two fastenings can also be achieved with different means, such as hydraulic or pneumatic devices.

The push button 12 can be replaced by a lever articulated on the cover 20 and directly connected to the control cable of the corresponding lever 7. Even if other structural variants of the safety fastenings for snowboards described above can be realized, these do not leave the context of the patent as they are characterised by the fact that they are interdependent, i.e. the cause the release of the twin fastening when one of the two fastenings, for any reason, releases the other ski boot.

We claim:

1. Safety fastenings for snowboards having interdependent connecting means between twin devices on each fastening, which cause the automatic reciprocal opening and immediate release of either fastening should the other fastening release the corresponding ski boot each one of said devices comprising a flat boxed body which cooperates with a grip (4) for frontally fixing the ski boot and fastening means (5) which block the heel of the ski boot; said fastening means (5) being provided with a control lever (7) which activates a heel grip of the fastening means said lever (7) being mechanically connected to a movable section (25) which is part of the twin fastening devices, so that traction generated by said member (25) is transmitted to the lever (7) of the other fastening device.

2. Safety fastenings for snowboards having interdependent connecting means between twin devices of each fastening, which cause the automatic reciprocal opening and immediate release of either fastening should the other fastening release the corresponding ski boot characterized by the fact that each fastening device comprises: a box (14) containing a fixed pin (12*a*) coaxial to a cylindrical spring (13) surmounted by a push button (12) shaped like an upside-down cup; an angular pivot lever (21), an angular member (25) with an extremity hinged (26) to the bottom of the box (14) and an extremity opposite said first extremity fixed to a control lever (24) projecting out from one side of the box (14); a traction spring (27) fixed to the box (14) and to the angular member (25) reacting elastically to pivotal movement of said section, said angular member being lockable in an oscillating position, against the reaction of the spring (27), by stopping means (23) brought into position by a branch of the pivot lever (21); one end (28) of a wire rope being connected to the angular member (25) while the other end (28*a*) is connected to the control lever (7) of the twin fastening; further characterized by the fact that when the push button (12) is pressed down, it acts on said opposite extremity of the pivot lever (21) causing it to oscillate and release the control lever (24) from the stopping means (23); and said cup on the push button (12) blocking the angular member (25) in an active position when the push button is pressed down.

3. Safety fastenings for snowboards having interdependent connecting means between twin devices on each fastening, which cause the automatic reciprocal opening and immediate release of either fastening should the other fastening release the corresponding ski boot each device characterized by an angular member (25) on each fastening which moves into an inactive position because it has been freed by a push button (12) engaging stopping means on the angular member by means of a wire rope (28) fixed to the angular member, said angular member releasing the other fastening by means of a control lever (7) on a heel grip.

* * * * *